United States Patent [19]

Anbe et al.

[11] Patent Number: 4,763,273

[45] Date of Patent: Aug. 9, 1988

[54] APPARATUS FOR DETECTING ECCENTRICITY OF ROLL IN ROLLING MILL

[75] Inventors: Yoshiharu Anbe, Kodaira; Toshimi Mineura, Hamura; Hajime Kai, Fuchu; Sumiyasu Kodama, Tokyo; Takao Dobashi, Hachioji, all of Japan

[73] Assignee: Kabushiki Kaisha Toshiba, Kanagawa, Japan

[21] Appl. No.: 889,265

[22] Filed: Jul. 25, 1986

[51] Int. Cl.[4] ..... B21B 37/00

[52] U.S. Cl. ..... 364/472; 72/8; 72/10; 72/20

[58] Field of Search ..... 364/472; 72/6, 8, 10, 72/11, 20, 21

[56] References Cited

U.S. PATENT DOCUMENTS

| | | | |
|---|---|---|---|
| 4,126,027 | 11/1978 | Smith, Jr. et al. | 72/11 |
| 4,299,104 | 11/1981 | Hayama et al. | 72/20 |
| 4,531,392 | 7/1985 | Puda | 72/19 |
| 4,545,228 | 10/1985 | Yamaguti et al. | 72/8 |
| 4,580,224 | 4/1986 | Gerber | 364/472 |
| 4,648,257 | 3/1987 | Oliver et al. | 72/8 |
| 4,656,854 | 4/1987 | Stewart et al. | 72/8 |

*Primary Examiner*—Jerry Smith
*Assistant Examiner*—Allen MacDonald
*Attorney, Agent, or Firm*—Foley & Lardner, Schwartz, Jeffery, Schwaab, Mack, Blumenthal & Evans

[57] ABSTRACT

An apparatus for detecting a roll eccentricity in a rolling mill includes mark pulse generators each provided for upper and lower rolls from which an eccentricity is to be detected, the mark pulse generator generating one pulse per one rotation of the roll, sampling pulse generators each provided for the upper and lower rolls for generating n pulses per one rotation of the roll, and a rolling pressure detector for the rolls.

After a mark pulse is generated, the rolling pressure signal outputted from the rolling pressure detector is first stored at the output timings of the sampling pulses. Next, a difference of the rolling pressure signals outputted from the rolling pressure detector is subjected to a Fourier transformation, the rolling pressure signals corresponding to those obtained after and before the relative phases of the upper and lower rolls are changed. The resultant values together with rotary angles and relative phases are used to output an eccentricity quantities independently for each roll.

4 Claims, 5 Drawing Sheets

APPARATUS FOR DETECTING ECCENTRICITY OF ROLL IN ROLLING MILL

BACKGROUND OF THE INVENTION

The present invention relates to an apparatus for detecting an eccentricity of a roll in a rolling mill, and more particularly to an apparatus incorporating an improved detection method for detecting an eccentricity of a backup roll.

In a rolling mill for rolling steel sheets or the like, a change in roll gap caused by an eccentricity of backup rolls results in the variation in thickness of rolled sheets or the variation in tension applied to the sheets. These variations significantly hinder the improvement on the manufacture quality and disturb a stable rolling operation.

Particularly, a rolling mill provided with a roll gap controller of a quick response has recently been used. To positively use this high response quality and manufacture rolled materials having an excellent accuracy in thickness, it is essential to eliminate an eccentricity of a roll.

Generally, it is common to detect a roll eccentricity in such a way that the sum of the eccentricity quantities of upper and lower backup rolls is detected from a rolling pressure signal.

However, a rolling operation with different peripheral velocities has recently been adopted to regulate the crown or shape of a sheet, wherein the upper and lower rolls have different peripheral velocities. In this case, since the eccentricity frequency of the upper and lower backup rolls differ from each other, a substantial eccentricity may be present even if the sum of the eccentricity quantities becomes 0. Thus, to obviate such a case, it is necessary to detect the eccentricity qualities of the upper and lower backup rolls independently from each other.

In view of this, a method has been adopted heretofore as described in the following wherein only a fundamental frequency of the roll eccentricity is considered in spite of the fact that it also includes harmonics.

The sum $\Delta S_1$ of the eccentricity quantities of the upper and lower backup rolls at a first measurement can be given by:

$$\Delta S_1 = X_A \sin(\omega_A t + \Phi_A) + X_B \sin(\omega_B t + \Phi_B) \quad (1)$$

Next, a second measurement is carried out under a condition that a relative phase between the upper and lower backup rolls is changed by $\alpha$ by rotating one of the two rolls and stopping the other. The sum $\Delta S_2$ at the second measurement can be given by:

$$S_2 = X_A \sin(\omega_A t + \Phi_A) + X_B \sin(\omega_B t + \Phi_B + \alpha) \quad (2)$$

The parameters used in the above two equations mean that:

$X_A$: eccentricity of the upper backup roll,
$X_B$: eccentricity of the lower backup roll,
$\omega_A$: angular velocity of the upper backup roll,
$\omega_B$: angular velocity of the lower backup roll,
$\Phi_A$: initial phase of the upper backup roll,
$\Phi B$: initial phase of the lower backup roll, and
$\alpha$: relative lead angle between the upper and lower backup rolls.

Thereafter, the data at the first measurement is subjected to a Fourier analysis to obtain an absolute value $|\Delta S_1|$ and phase $\epsilon_1$ of $\Delta S_1$ of the equation (1). Similarly, the data at the second measurement is subjected to a Fourier analysis to obtain an absolute value $|\Delta S_2|$ and phase $\epsilon_2$ of $\Delta S_2$ of the equation (2). Consequently, each eccentricity $\Delta S_1$ and $\Delta S_2$ can be given by:

$$\begin{aligned} \Delta S_1 &= |\Delta S_1| \sin(\omega t + \epsilon_1) \\ &= X_A \sin(\omega_A t + \Phi_A) + X_B \sin(\omega_B t + \Phi_B) \end{aligned} \quad (3)$$

$$\begin{aligned} \Delta S_2 &= |\Delta S_2| \sin(\omega t + \epsilon_2) \\ &= X_A \sin(\omega_A t + \Phi_A) + X_B \sin(\omega_B t + \Phi_B + \alpha) \end{aligned} \quad (4)$$

The eccentricity quantities $X_A$ and $X_B$ and phases $\Phi_A$ and $\Phi_B$, respectively of the upper and lower backup rolls, are solved from the equations (3) and (4). However, according to the prior art, it has been assumed that $\omega_A = \omega_B$. Therefore, each solution $X_A$, $X_B$, $\Phi A$ or $\Phi_B$ becomes:

$$X_A = \frac{\sqrt{|\Delta S_1|^2 + |\Delta S_2|^2 - 2|\Delta S_1| \cdot |\Delta S_2| \cos(\alpha - \beta)}}{2\sin\frac{\alpha}{2}}$$

$$X_B = \frac{\sqrt{|\Delta S_1|^2 + |\Delta S_2|^2 - 2|\Delta S_1| \cdot |\Delta S_2| \cos\beta}}{2\sin\frac{\alpha}{2}}$$

$$\Phi_A = \epsilon_1 - \cos^{-1}\frac{|\Delta S_1|^2 + X_A^2 - X_B^2}{2|\Delta S_1| \cdot X_B}$$

$$\Phi_B = \epsilon_2 - \cos^{-1}\frac{|\Delta S_2|^2 + X_B^2 - X_A^2}{2|\Delta S_1| \cdot X_B}$$

where $\beta$ is a phase difference between $\Delta S_1$ and $\Delta S_2$.

As stated above, in the conventional method, it has been assumed that $\omega_A = \omega_B$ in solving the eccentricity and phase.

However, in case where the diameters of the upper and lower work rolls or backup rolls differ from each other, the angular velocities in rotation of the upper and lower backup rolls generally differ from each other so that the equations (3) and (4) cannot be solved in case of different peripheral velocities. Therefore, with the conventional method, it is difficult to detect the correct eccentricity of a roll.

SUMMARY OF THE INVENTION

It is therefore an object of the present invention to provide a roll eccentricity detecting apparatus capable of detecting each eccentricity of the upper and lower backup rolls with ease and precision.

The other objects of the present invention is to provide a roll eccentricity detecting apparatus capable of detecting each eccentricity of the upper and lower backup rolls even when the angular velocities thereof differ from each other.

The above objects can be achieved by the provision of an apparatus for detecting a roll eccentricity in a rolling mill, which comprises:

mark pulse generators each provided for upper and lower rolls from which an eccentricity is to be detected, the mark pulse generator generating one pulse per one rotation of the roll, and sampling pulse generators each provided for the upper and lower rolls for generating n pulses per one rotation of the roll;

a rolling pressure detector for detecting a rolling pressure of the rolls;

a roll eccentricity calculation/memory unit which, during rotation of the rolls, samples the rolling pressure signal outputted from the rolling pressure detector at the output timings of the sampling pulse generator after the time when the mark pulse generator generates a pulse, and calculates to store the roll eccentricity of each of the rolls based on the rolling pressure signal;

a Fourier transformation/calculation unit for calculating a difference between the outputs from the roll eccentricity calculation/memory unit and performing a Fourier transformation of the difference, the outputs corresponding to those before and after the relative phases of the upper and lower rolls are changed;

an angle calculation unit for outputting signals regarding the rotary angle and the relative phase of each of the rolls, based on the outputs from the mark pulse generators and the sampling pulse generators; and an eccentricity quantities outputting unit for outputting the eccentricity quantities independently for each of the rolls, based on the output signals from the Fourier transformation calculation unit and the angle calculation unit.

DESCRIPTION OF THE PREFERRED EMBODIMENT

Figure 1:
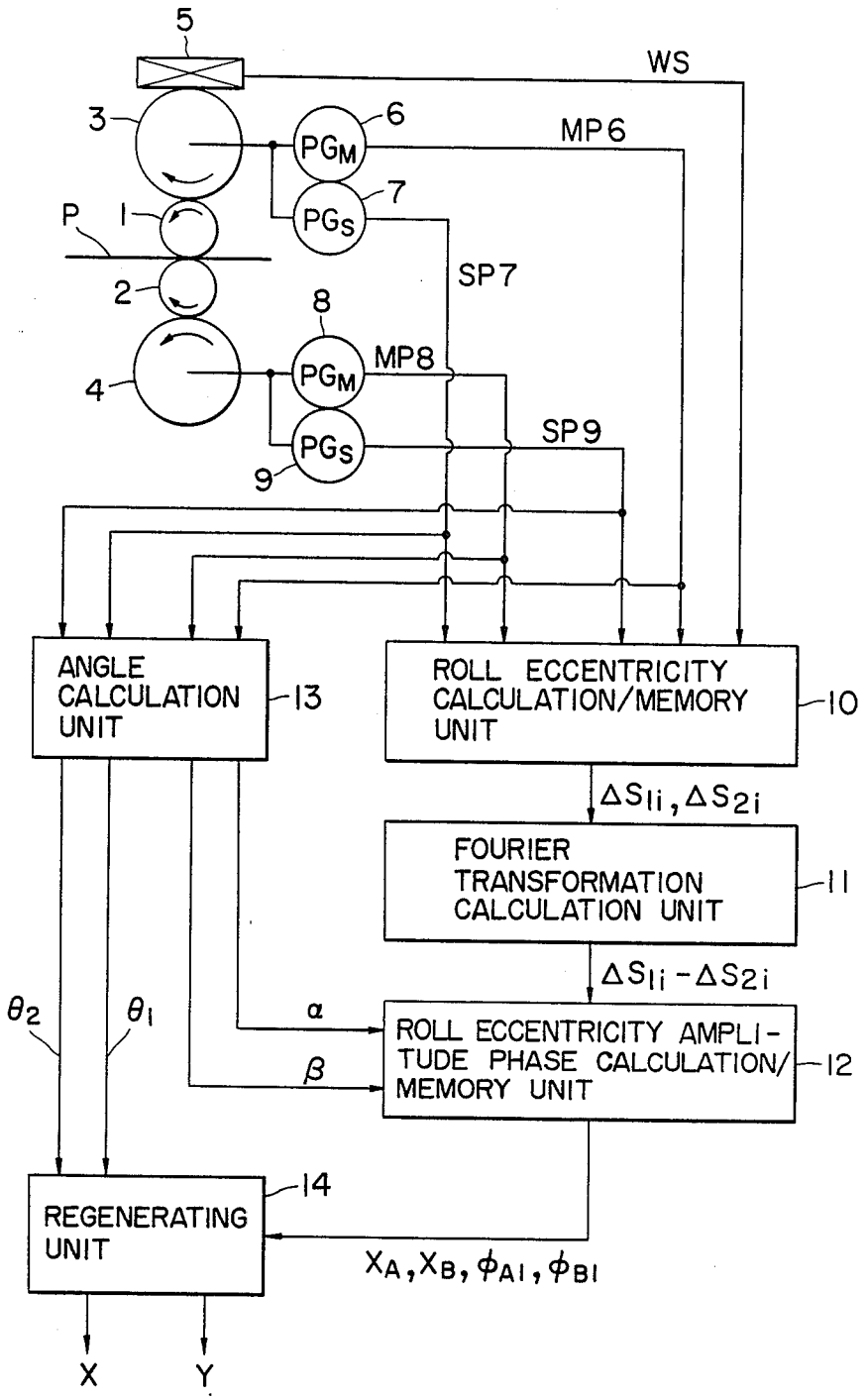
FIG. 1 is a block diagram showing the roll eccentricity detecting apparatus according to an embodiment of the present invention.

FIG. 1 is a block diagram of the roll eccentricity detecting apparatus according to an embodiment of the present invention.

In the figure, the material P is rolled between upper and lower work rolls 1 and 2 on which upper and lower backup rolls 3 and 4 are mounted. A rolling pressure detector 5 is provided on the upper backup roll 3. Two pairs of pulse generators 6, 7 and 8, 9 are respectively coupled to the upper and lower backup rolls 3 and 4.

This embodiment also includes a roll eccentricity calculation/memory unit 10, a Fourier transformation/-calculation unit 11, a roll eccentricity amplitude and phase calculation/memory unit 12, an angle calculation unit 13 and a regenerating unit 14.

During a kiss-roll operation of the upper and lower work rolls 1 and 2, the pulse generators 6 and 8 generate mark pulses MP6 and MP8 respectively, while the pulse generators 7 and 9 generate sampling pulses SP7 and SP9, respectively.

The pulse generators 6 and 8 each generate one mark pulse per one rotation of the respective backup rolls 3 and 4, while the pulse generators 7 and 9 each generate n pulse per one rotation of the respective backup rolls 3 and 4. As the number n of sampling pulses, a value of 2's power is generally adopted which is suitable for processing by a Fast Fourier Transformation (FFT) to be described later. In this case, if the value is more than 64, a precision sufficient for practical use may be obtained.

After the pulse generators 6 and 8 for the backup rolls 3 and 4 generate mark pulses MP6 and MP8, the roll eccentricity calculation/memory unit 10 then reads a rolling pressure signal WS from the rolling pressure detector 5 every time the pulse generators 7 and 9 generate sampling pulses SP7 and SP9.

Figure 2:
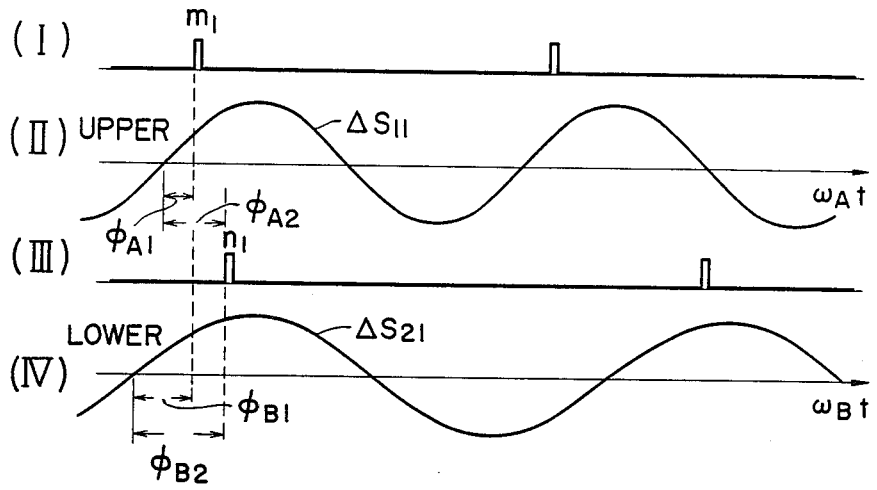
FIGS. 2(*a*) and 2(*b*) show waveforms and timings associated with first and second measurements, respectively.
Figure 2:
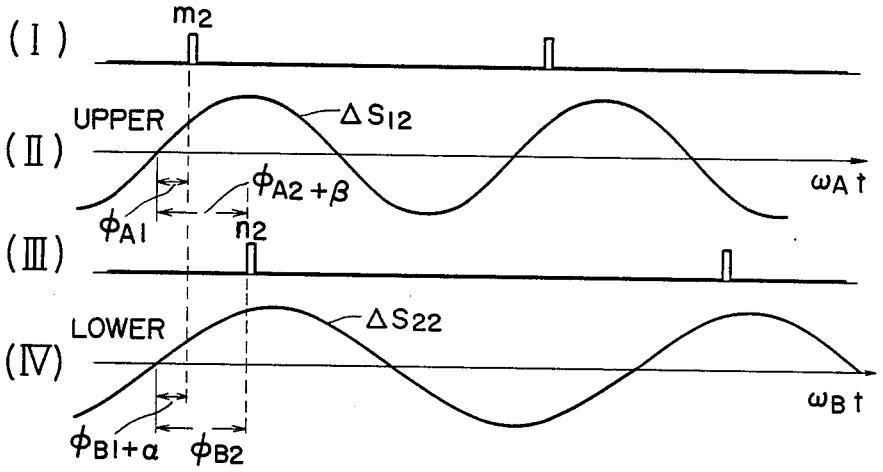

FIGS. 2(*a*) and 2(*b*) show waveforms and timings illustrating the operation principle of the present invention, wherein FIG. 2(*a*) shows waveforms associated with a first measurement and FIG. 2(*b*) shows waveforms associated with a second measurement.

FIG. 2(*a*) (i) shows mark pulse $m_1$ at the first measurement for the upper backup roll 3; FIG. 2(*a*) (ii) shows an eccentricity waveform for the backup roll 3 obtained from rolling pressure signals WS in response to sampling pulses after mark pulse $m_1$; FIG. 2(*a*) (iii) shows mark pulse $n_1$ at the first measurement for the lower backup roll 4; and FIG. 2(*a*)(iv) shows an eccentricity waveform for the lower backup roll 4 obtained from rolling pressure signals WS in response to sampling pulses after mark pulse $n_1$. FIGS. 2(*b*) (i), (ii), (iii) and (iv) for the second measurement correspond to those at the first measurement.

At the first measurement, after mark pulses MP6=ml and MP8=$n_1$ are generated, sampling pulses SP7 and SP9 are sequentially generated and on the basis of these sampling pulses, the roll eccentricity $\Delta S_{11}$ and $\Delta S_{21}$ are obtained:

$$\Delta S_{11}=X_A \sin(\omega_A t+\Phi_{A1})+X_B \sin(\omega_B t+\Phi_{B1}) \quad (5)$$

$$\Delta S_{21}=X_A \sin(\omega_A t+\Phi_{A2})+X_B \sin(\omega_B t+\Phi_{B2}) \quad (6)$$

At the second measurement shown in FIG. 2(*b*), first the relative phase between the upper and lower backup rolls 3 and 4 (the phase regarding the lower backup roll) is changed by $\alpha$. Then, after mark pulses MP6=$m_2$, MP=$n_2$, sampling pulses SP7 and SP9 are successively generated and on the basis of thses sampling pulses, the roll eccentricity $\Delta S_{12}$ and $\Delta S_{22}$ are obtained:

$$\Delta S_{12}=X_A \sin(\omega_A t+\Phi_{A1})+X_B \sin(\omega_B t+\Phi_{B1}+\alpha) \quad (7)$$

$$\Delta S_{22}=X_A \sin(\omega_A t+\Phi_{A2}+\beta)+X_B \sin(\omega_B t+\Phi_{B2}) \quad (8)$$

where $\Phi_{A1}$ and $\Phi_{B1}$ represent initial eccentricity quantities of the upper and lower backup rolls at the timing of mark pulse m1, respectively; $\Phi_{A2}$ and $\Phi_{B2}$ represent initial eccentricity quantities of the upper and lower backup rolls at the timing of mark pulse $n_1$; and $\beta$ represents a quantity of phase change of the upper backup roll 3 at the timing when data sampling starts on the basis of the lower backup roll.

Figure 3:
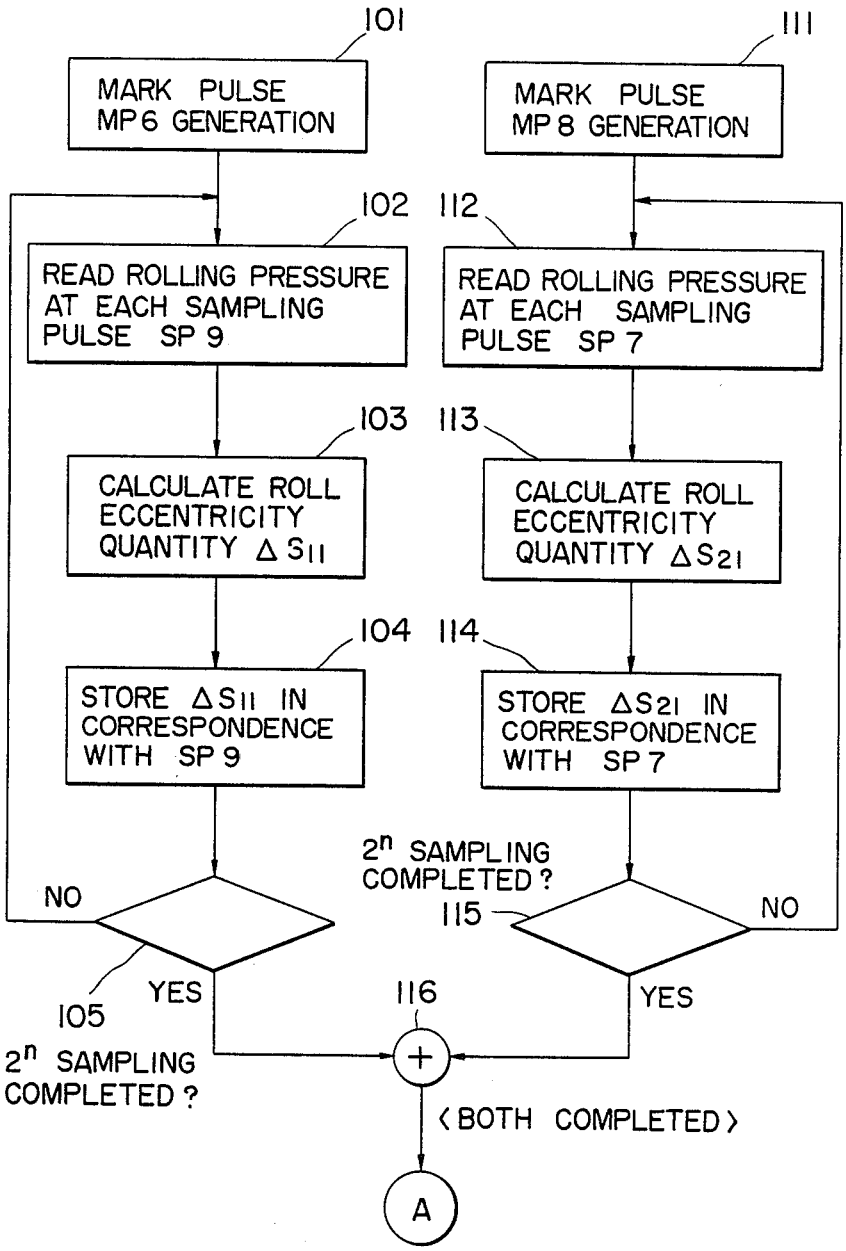
FIGS. 3 and 4 are flow charts showing the first and second measurements, respectively.
Figure 4:
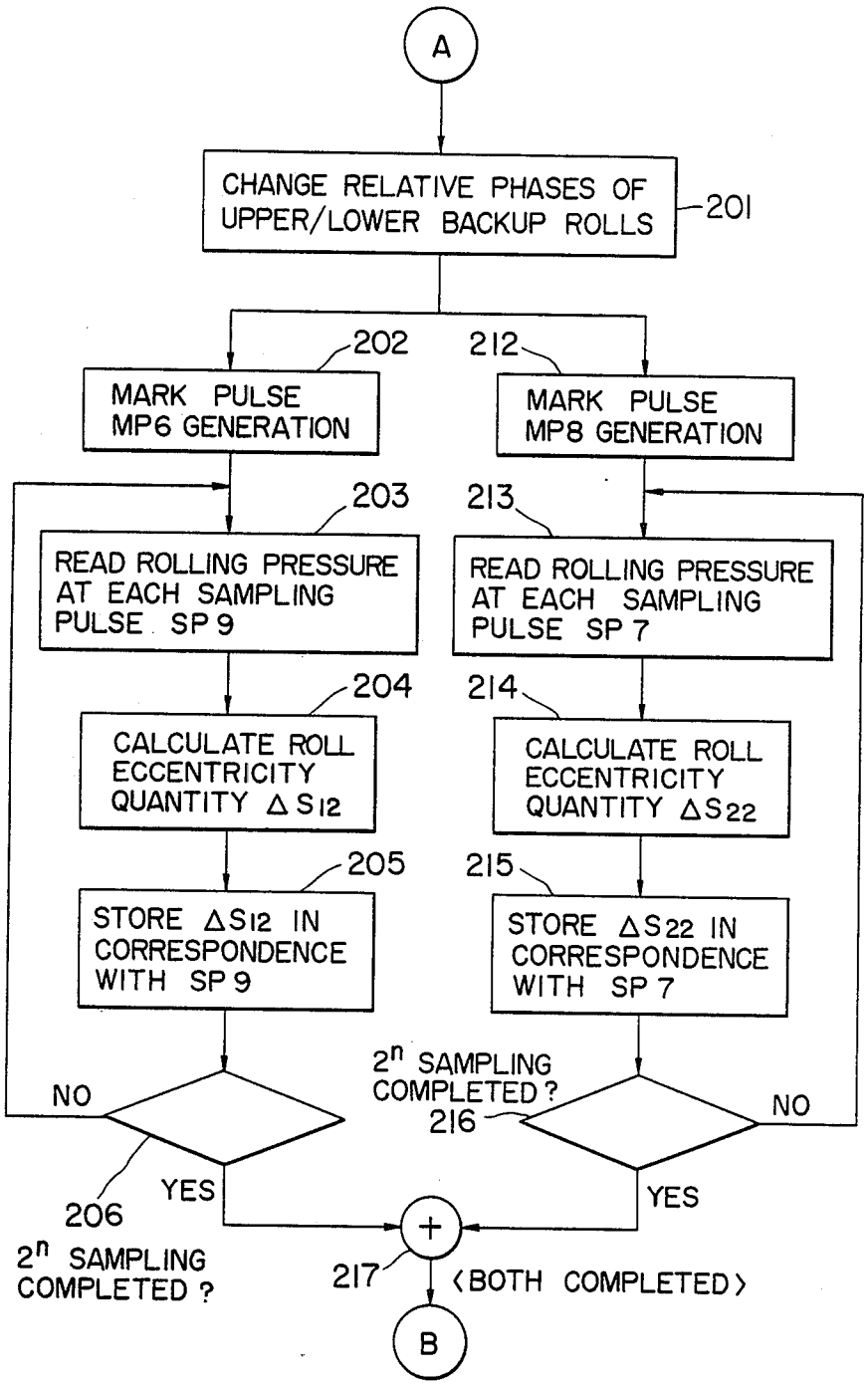

The first and second measurements carried out by the roll eccentricity calculation/memory unit 10 are illustrated in the flow charts of FIGS. 3 and 4, respectively. The flows on the left of FIGS. 3 and 4 are for the operation associated with the upper backup roll 3, while the flows on the right thereof are for the operation with the lower backup roll 4. The flow chart of FIG. 5 to be described later has a similar arrangement as above.

It is noted here that in changing the relative phase between the upper and lower backup rolls 3 and 4 prior to the second measurement, the phase change by $\alpha$ is for the lower backup roll 4 and the relative phase $\beta$ for the upper backup roll 3 is unambiguously determined.

Next, the first measurement procedure will be described with reference to FIG. 3.

The first measurement for the upper backup roll 3 starts when $m_1$ mark pulse MP6 is generated (block 101), and a rolling pressure is read each time sampling pulse SP9 for the lower backup roll 4 is generated (block 102). In case where a Fast Fourier Transformation (FFT) is incorporated as a Fourier transformation and the number n of samplings is determined 64, then data sampling is carried out for each 3 msec. Next, the roll eccentricity quantities $\Delta S_{11}$ are calculated (block 103) and stored (block 104) in accordance with the read-out rolling pressures. When the number of stored $\Delta S_{11}$ becomes $2^n$, the above operations are terminated, and if not, the operations from block 102 to block 104 are repeated (block 105).

The first measurement for the lower backup roll 4 starts when $n_1$ mark pulse MP8 is generated (block 111), and a rolling pressure is read each time sampling pulse SP7 for the upper backup roll 3 is generated (block 112). Next, the roll eccentricity quantities $\Delta S_{21}$ are calculated (block 113) and stored (block 114) in accordance with the read-out rolling pressures. When the number of stored $\Delta S_{21}$ becomes $2^n$, the above operations are terminated, and if not, the operations are repeated (block 115).

Upon storage completion of the roll eccentricity quantities $\Delta S_{11}$, $\Delta S_{21}$ up to $2^n$ times, the first measurement is completed (block 116).

Next, the second measurement procedure will be described with reference to FIG. 4. As described previously, the phases of the upper and lower backup rolls 3 and 4 are respectively shifted by $\alpha$, $\beta$, prior to the start of the second measurement (block 201). The second measurement for the upper backup roll 3 starts when $m_2$ mark pulse MP6 is generated (block 202). Thereafter, similar to blocks 102 to 105 of FIG. 3, reading of rolling pressures, calculation of roll eccentricity quantities $\Delta S_{12}$ and storage of $\Delta S_{12}$ up to $2^n$ times, are respectively carried out (blocks 203 to 206). The second measurement for the lower backup roll 4 starts when $n_2$ mark pulse MP8 is generated (block 212). Thereafter, similarly to blocks 112 to 115 of FIG. 3, reading of rolling pressures, calculation of roll eccentricity quantities $\Delta S_{22}$ and storage thereof up to $2^n$ times, are respectively carried out (blocks 213 to 216).

Upon storage completion of the roll eccentricity quantities $\Delta S_{12}$, $\Delta S_{22}$ up to $2^n$ times, the second measurement is completed (block 217).

As seen from the flow charts of FIGS. 3 and 4, the roll eccentricity calculation/memory unit 10 solves instantaneous values of $\Delta S_{1i}$ or $\Delta S_{2i}$ (i is the number of measurements), each value being obtained through $2^n$ samplings.

The Fourier transformation/calculation unit 11 calculates $\Delta S_{11}-\Delta S_{12}$, $\Delta S_{21}-\Delta S_{22}$ ($\Delta S_{1i}-\Delta S_{2i}$ in general notation) based on output eccentricity signals $\Delta S_{11}$, $\Delta S_{21}$, $\Delta S_{12}$, $\Delta S_{22}$ from the roll eccentricity calculation/memory unit 10, e.g., $$\begin{aligned}\delta_{1i} &= \Delta S_{11} - \Delta S_{12} = X_B\sin(\omega_B t + \Phi_{B1}) - X_B\sin(\omega_B t + \Phi_{B1} + \alpha) \\ &= 2X_B\sin(-\alpha/2)\cos(\omega_B t + \Phi_{B1} + \alpha/2)\end{aligned} \tag{9}$$

to eliminate the amplitude $X_A$ and phase $\Phi_{A1}$ of the upper backup roll eccentricity. Then, through a Fourier transformation, the following result is given:

$$\Delta S_{11}-\Delta S_{12}=X_1 \sin(\omega_B t+\epsilon_1) \tag{10}$$

Similarly, a calculation $$\begin{aligned}\delta_{2i} &= \Delta S_{21} - \Delta S_{22} = X_A\sin(\omega_A t + \Phi_{A2}) - X_A\sin(\omega_A t + \Phi_{A2} + \beta) \\ &= 2X_A\sin(-\beta/2)\cos(\omega_A t + \Phi_{A2} + \beta/2)\end{aligned} \tag{11}$$

is made to eliminate the amplitude $X_B$ and phase $\Phi_{B2}$ of the lower backup roll. Then, through a Fourier transformation, the following result is given:

$$\Delta S_{21}-\Delta S_{22}=X_2 \sin(\omega_A t+\epsilon_2) \tag{12}$$

The roll eccentricity amplitude and phase calculation/memory unit 12 outputs the following values, based upon the outputs $\Delta S_{1i}-\Delta S_{2i}$ from the Fourier transformation calculation/memory unit 11 and outputs $\alpha$ and $\beta$ from the angle calculation unit 13:

$$\left.\begin{aligned} X_B &= \frac{X_1}{2\sin\left(-\frac{\alpha}{2}\right)} \\ \Phi_{B1} &= \epsilon_1 - \frac{\alpha}{2} + \frac{\pi}{2}\end{aligned}\right\} \tag{13}$$

$$\left.\begin{aligned} X_A &= \frac{X_2}{2\sin\left(-\frac{\beta}{2}\right)} \\ \Phi_{A2} &= \epsilon_2 - \frac{\beta}{2} + \frac{\pi}{2}\end{aligned}\right\} \tag{14}$$

These values $X_A$, $X_B$, $\Phi_{A1}$ and $\Phi_{B1}$ are inputted to the reproducing unit 14.

Figure 5:
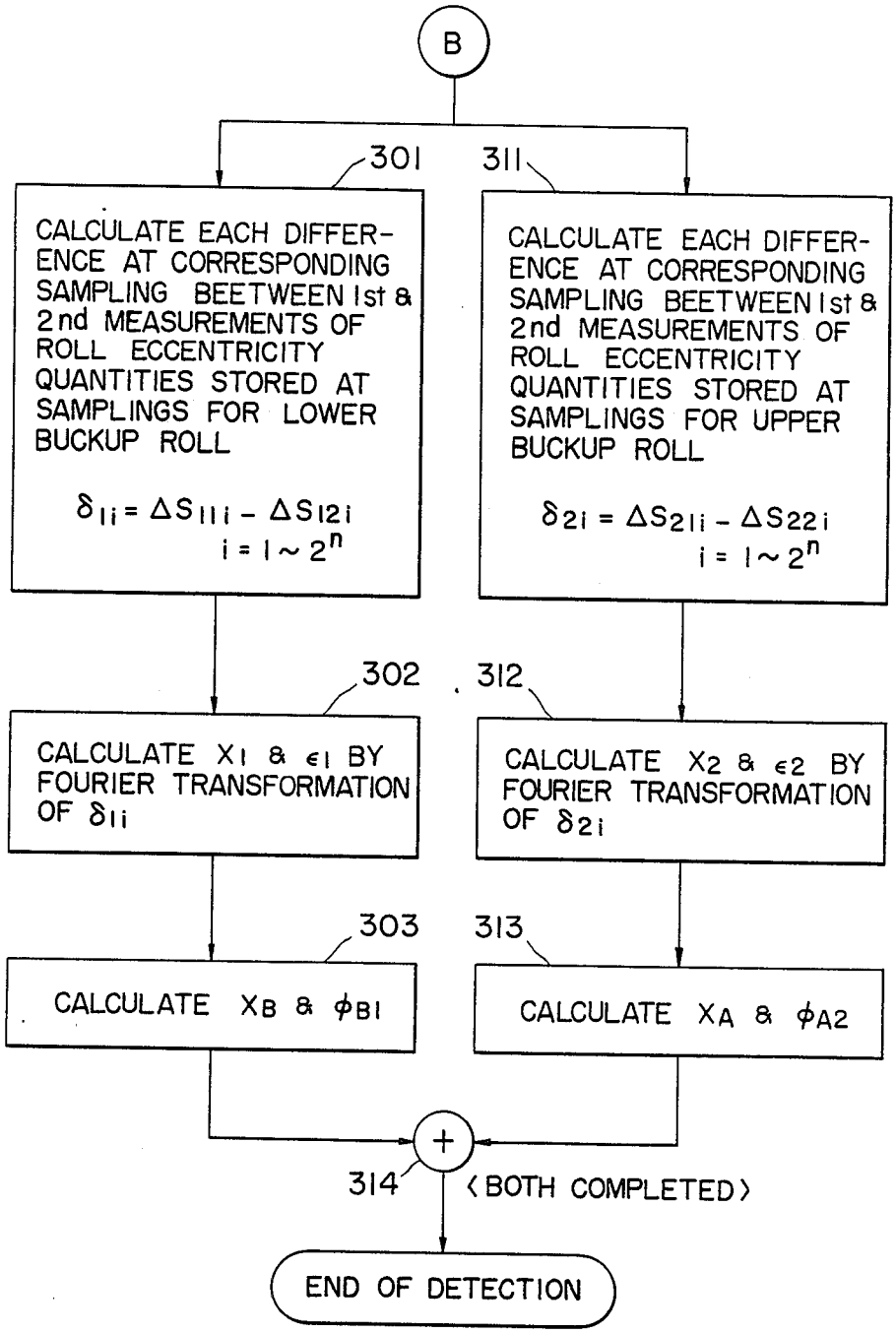
FIG. 5 is a flow chart showing the calculation of the amplitude and initial phase of a roll eccentricity.

The calculation procedure of the amplitude and initial phase of the lower backup roll eccentricity will be described with reference to the flow chart of FIG. 5. As to the lower backup roll 4, calculated at a corresponding sampling timing in the first and second measurements is each difference between the roll eccentricity quantities $\Delta S_{11}$ (blocks 101 to 105 of FIG. 3) stored at each sampling pulse SP9 at the first measurement and the roll eccentricity $\Delta S_{12}$ (blocks 202 to 206 of FIG. 4) stored at each sampling pulse SP7 at the second measurement. Namely, a calculation $\delta_{1i}=\Delta S_{11i}-\Delta S_{12i}$ is carried out, where $i=1$ to $2^n$ and the roll eccentricity quantities $\Delta S_{11i}$ and $\Delta S_{12i}$ represent stored $\Delta S_{11}$ and $\Delta S_{12}$ for i-th order (block 301). Next, $2^n\times\delta_1$ are subjected to Fourier transformations to accordingly calculate the amplitude $X_1$ and phase $\epsilon_1$ (block 302). Next, in accordance with the equation (13), the amplitude $X_B$ and initial phase $\Phi_{B1}$ are calculated respectively based on the amplitude $X_1$ and phase $\epsilon_1$ (block 303).

As to the upper backup roll 3, similar to block 301, each difference $\delta_{21}$ between the roll eccentricity quantities $\delta S_{21}$, $\Delta S_{22}$ is calculated (block 311). After Fourier transformations similar to block 302 (block 312), the amplitude $X_A$ and initial phase $\Phi_{A2}$ are calculated in accordance with the equation (14) (block 313).

At the end of the above procedure, the eccentricity measurement is completed (block 314).

The angle calculation unit 13 of FIG. 1 obtains rotary angles $\theta_1$ of the upper and lower backup rolls 3 and 4, based on mark pulses MP6 and MP8 and sampling pulses SP7 and SP9 supplied from the pulse generators 6 to 9 for the upper and lower backup rolls 3 and 4, in accordance with the following equation:

$$\theta = I \cdot \Delta\theta \tag{15}$$

where I represents the count of sampling pulses and $\Delta\theta$ represents an angle between adjacent sampling pulses. $\theta$ is set at 0 when a mark pulse is generated, and the count I is cleared every time a mark pulse is generated.

Therefore, the angle calculation unit 13 outputs rotary angles $\theta_1$ and $\theta_2$ of the respective backup rolls 3 and 4, and relative phases $\alpha$ and $\beta$ between the rolls. The signals $\theta_1$ and $\theta_2$ are inputted to the regenerating unit 14, while the signals $\alpha$ and $\beta$ are inputted to the roll eccentricity amplitude and phase calculation/memory unit 12.

Prior to the start of the second measurement, the relative phases of the upper and lower backup rolls are shifted by $\alpha$ relative to the lower backup roll 4 and by $\beta$ relative to the upper backup roll 3. In this case, the two rolls are rotated while checking their phase angles. When the lower backup roll 4 becomes of a relative phase $\alpha$, the two rolls are stopped and at this time the relative phase of the upper backup roll 3 is automatically and unambiguously determined at $\beta$.

The regenerating unit 14 solves the eccentricity quantities X and Y for the upper and lower backup rolls, based on the outputs $X_A$, $X_B$, $\Phi_{A1}$ and $\Phi_{B1}$ from the roll eccentricity amplitude and phase calculation/memory unit 12 and the outputs $\theta_1$, $\theta_2$ from the angle calculation unit 13:

$$\left.\begin{aligned} X &= X_A \sin(\theta_1 + \Phi_{A2}) \\ Y &= X_B \sin(\theta_2 + \Phi_{B1}) \end{aligned}\right\} \tag{16}$$

where $\Phi_{A2}$ represents an initial phase at the time when mark pulse $n_1$ of FIG. 1 is generated, and $\Phi_{B1}$ represents an initial phase at the time when mark pulse $m_1$ is generated.

Therefore, it is necessary to use absolute rotary angles where angles $\theta_1 = 0.0$ and $\theta_2 = 0.0$ correspond to the timings of respective mark pulses.

Particularly, assuming that a rotary angle between mark pulse $m_1$ and mark pulse $n_1$ for the upper backup roll 3 is $\theta_U$ and that a rotary angle between mark pulse $m_1$ and mark pulse $n_1$ for the lower backup roll 4 is $\theta_L$. Then, normalized eccentricity quantities are given by:

$$X = X_A \sin(\theta_1 + \Phi_{A2} + \theta_U)$$

$$Y = X_B \sin(\theta_2 + \Phi_{B1} + \theta_L)$$

where $\theta_U$ and $\theta_L$ have values of an inverted sign, i.e., $|\theta_U| = |\theta_L|$.

Such normalization by the regenerating unit 14 may be conducted by storing the outputs $\theta_1$ and $\theta_2$ from the angle calculation unit 13 at the timings of mark pulses $m_1$ and $n_1$.

Although the eccentricity measurement is performed during a kiss-roll operation of the work rolls in the above embodiment, such measurement may be performed in an ordinary rolling state, which leads to a more precise measurement.

With the above construction of the present invention, Fourier analysis is employed for the data from each backup roll. Therefore, it is possible to detect a roll eccentricity precisely even when the upper and lower backup rolls are rotated at different angular velocities, e.g., even when the two rolls have different diameters. Thus, a roll eccentricity detecting apparatus for a rolling mill capable of manufacturing the materials with a high precision sheet thickness is realized.

What is claimed is:

1. An apparatus for detecting a roll eccentricity in a rolling mill comprising:

mark pulse generators provided, respectively, for upper and lower rolls from which an eccentricity is to be detected, said mark pulse generators genterating, respectively, one pulse per one rotation of said rolls, and sampling pulse generators provided, respectively, for said upper and lower rolls for generating, respectively, n pulses per one rotation of said rolls;

a rolling pressure detector for detecting a rolling pressure of said rolls and outputting a rolling pressure signal indicative thereof;

a roll eccentricity calculation/memory unit which, during rotation of said rolls, samples the rolling pressure signal outputted from said rolling pressure detector at the output timings of said sampling pulse generators after the time when said mark pulse generators generate said mark pulses, and calculates to store the roll eccentricity of each of said rolls based on said rolling pressure signal;

a Fourier transformation/calculation unit for calculating a difference between outputs from said roll eccentricity calculation/memory unit and performing a Fourier transformation of said difference, said outputs corresponding to those before and after relative phases of said upper and lower rolls are changed;

an angle calculation unit for outputting signals regarding the rotary angle and said relative phase of each of said rolls, based on the outputs form said mark pulse generators and said sampling generators; and an eccentricity quantities outputting unit for outputting the eccentricity quantity independently for each of said rolls, based on the output signals from said Fourier transformation calculation unit and said angle calculation unit.

2. An apparatus for detecting a roll eccentricity in a rolling mill according to claim 1, wherein said rotation of said rolls is effected at a kiss-roll state.

3. An apparatus for detecting a roll eccentricity in a rolling mill according to claim 1, wherein said rotation of said rolls is effected at an ordinary rolling state.

4. An apparatus for detecting a roll eccentricity in a rolling mill according to claim 1, wherein said Fourier transformation is a fast Fourier transformation.

* * * * *